US011039266B1

(12) United States Patent
Holman et al.

(10) Patent No.: US 11,039,266 B1
(45) Date of Patent: Jun. 15, 2021

(54) BINAURAL REPRODUCTION OF SURROUND SOUND USING A VIRTUALIZED LINE ARRAY

(71) Applicant: Apple Inc., Cupertino, CA (US)

(72) Inventors: Tomlinson Holman, Cupertino, CA (US); Martin E. Johnson, Los Gatos, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 16/584,625

(22) Filed: Sep. 26, 2019

Related U.S. Application Data

(60) Provisional application No. 62/738,862, filed on Sep. 28, 2018.

(51) Int. Cl.

| | |
|---|---|
| ***H04S 7/00*** | (2006.01) |
| ***H04S 1/00*** | (2006.01) |
| ***H04R 5/04*** | (2006.01) |
| ***H04R 5/033*** | (2006.01) |
| ***H04R 3/04*** | (2006.01) |

(52) U.S. Cl.
CPC ..... *H04S 7/307* (2013.01); *H04R 3/04* (2013.01); *H04R 5/033* (2013.01); *H04R 5/04* (2013.01); *H04S 1/007* (2013.01); *H04S 2420/01* (2013.01)

(58) Field of Classification Search
CPC ..... H04S 7/307; H04S 1/007; H04S 2420/01; H04R 3/04; H04R 5/033; H04R 5/04
See application file for complete search history.

(56) References Cited

U.S. PATENT DOCUMENTS 6,498,857 B1 * 12/2002 Sibbald ..... H04S 7/30 381/1
2013/0142355 A1 6/2013 Isaac et al.
2015/0131824 A1 * 5/2015 Nguyen ..... H04S 7/307 381/300

OTHER PUBLICATIONS

Merimaa, Juha, "Modification of HRTF Filters to Reduce Timbral Effects in Binaural Synthesis", Oct. 2009, Audio Engineering Society, AES 127th Convention, pp. 1-14. (Year: 2009).*
Gardner et al., "HRTF Measurements of a KEMAR Dummy-Head Microphone", May 1994, MIT Media Lab, Technical Report #280, pp. 1-7. (Year: 1994).*
Digital Augmented Reality Audio Headset by Jussi Ramo and Vesa Valimaki; Hindawi Publishing Corporation Journal of Electrical and Computer Engineering vol. 2012, Article ID 457374, 13 pages.
Audio Engineering Society Convention Paper on the audibility of comb-filter distortions, by Stefan Brunner, Hans-Joachim Maempel, and Stefan Weinzierl; Presented at the 122nd Convention May 5-8, 2007 Vienna, Austria; 8 Pages.
New Factors in Sound for Cinema and Television, by Tomlinson Holman; Presented at the 89th Convention of the Audio Engineering Society, Los Angeles, CA, 1990; J. Audio Eng. Soc., vol. 39. No. 7/8, 1991; 12 Pages.

* cited by examiner

*Primary Examiner* — Fan S Tsang
*Assistant Examiner* — Daniel R Sellers
(74) *Attorney, Agent, or Firm* — Womble Bond Dickinson (US) LLP

(57) ABSTRACT

A method for producing a diffuse field that is non-localizable and without timbre inaccuracies. A processor receives an audio bitstream containing an at least one surround channel. The surround channel is rendered as an at least one virtualized line array source. Timbre correction is applied to the virtualized line array source. Other aspects are also described and claimed.

17 Claims, 6 Drawing Sheets

BINAURAL REPRODUCTION OF SURROUND SOUND USING A VIRTUALIZED LINE ARRAY

This non-provisional patent application claims the benefit of the earlier filing date of U.S. provisional application No. 62/738,862 filed 28 Sep. 2018.

FIELD

Aspects in the disclosure here relate generally to digital audio signal processing techniques for binaural reproduction (e.g., through a headset) of surround sound channels.

BACKGROUND

Surround sound is a technique for using multiple audio channels routed to multiple speakers more or less surrounding a listener to produce the perception of sound spatialization. In one case, this technique relies on a listener's ability to identify the location or origin of a detected sound in direction and distance, and directs different sound elements to one or more speakers in order to produce a desired localization of the sound element. In another case, more than one speaker may reproduce a generally non-localizable sound field typically for ambience and reverberation. Several methods of surround sound have been developed, such as multichannel audio, object-based audio, and scene-based audio. Multichannel audio is based on specific loudspeaker layouts, and recorded sound channels in 1:1 correspondence with the speaker channels. Object-oriented audio may be divided into two types of sound channels: beds, and objects. Object-oriented audio is more flexible than conventional multichannel audio because the strict 1:1 correspondence between recorded channels and loudspeaker channels is not necessary; Objects have metadata from which a system derives the best representation of the audio objects over the loudspeaker channels at hand in a given playback environment. All of these methods of surround sound generally include one or more recorded surround channels that contain ambient sound and/or reverberation, which gives the listener a sense of envelopment because the listener is not able to localize the source of the sound.

Existing techniques for reproducing the ambient sound of the surround channel during headphone playback have struggled with producing envelopment and suppressing localization of the sound using ambience and reverberation that is meant to be enveloping. Further, advancements have been made in the field of virtualizing audio, which attempts to create the perception for the listener that there are many more sources of sound than are actually present.

SUMMARY

Generally, aspects of the disclosure here relate to a system and method for binaural reproduction of a surround sound channel using a virtualized line array.

In one aspect, a method for producing a diffuse surround sound field that is non-localizable and with reduced timbre inaccuracies starts with a processor receiving an audio bitstream that contains a surround channel. The processor then renders the surround channel as at least one virtualized line array source. Timbre correction is applied to the virtualized line array source. A number of speaker output signals are generated by a spatial sound processor from the timbre-corrected virtualized line array source, for driving a plurality of speakers.

The virtualized line array source has the characteristics of a line array speaker in a simulated virtual environment. In one aspect of the disclosure the virtualized line array source is comprised of a plurality of finite source elements that may be arranged substantially at the same elevation on the azimuth and at sufficient density so as to appear continuous. In this case the purpose is to reproduce the surround channel of a large body of content that has been made in sound channel layouts known as 5.1-channel or 7.1-channel sound.

Any one of several timbre matching techniques may be applied to the virtualized line array source. A first method is to apply an inverse head related transfer function, HRTF filter to a second finite source element so as to match the perceived approach vector component response angle of a first finite source element. In another method, the timing of playback by each finite source element of the virtualized line array source is non-uniform and is delayed for elements close to and at the center of the virtualized line array source. In yet another method, comb filtering is applied to the virtualized line array source.

In one aspect, a system for producing a diffuse surround sound field that is non-localizable and with reduced timbre inaccuracies comprises a processor and memory having stored therein instructions that when executed by the processor receive an audio bitstream that contains a surround channel. The processor then renders the surround channel as at least one virtualized line array source. Timbre correction is applied to the virtualized line array source. A number of speaker output signals are generated from the timbre-corrected virtualized line array source for driving a plurality of speakers.

The above summary does not include an exhaustive list of all aspects of the present disclosure. It is contemplated that the invention includes all systems, apparatuses and methods that can be practiced from all suitable combinations of the various aspects summarized above, as well as those disclosed in the Detailed Description below and particularly pointed out in the claims filed with the application. Such combinations may have particular advantages not specifically recited in the above summary.

BRIEF DESCRIPTION OF THE DRAWINGS

The aspects of the invention are illustrated by way of example and not by way of limitation in the figures of the accompanying drawings in which like references indicate similar elements. It should be noted that references to "an" or "one" aspect in this disclosure are not necessarily to the same aspect, and they mean at least one. Also, in the interest of conciseness and reducing the total number of figures, a given figure may be used to illustrate the features of more than one aspect of the disclosure, and not all elements in the figure may be required for a given aspect. In the drawings.

DETAILED DESCRIPTION

In the following description, numerous specific details are set forth. Whenever the shapes, relative positions and other aspects of the parts described are not explicitly defined, the scope of the invention is not limited only to the parts shown, which are meant merely for the purpose of illustration. Also, while numerous details are set forth, it is understood that some aspects of the disclosure may be practiced without these details.

In the description, certain terminology is used to describe the various aspects of the disclosure here. For example, in certain situations, the terms "component," "unit," "module," and "logic" are representative of hardware and/or software configured to perform one or more functions. For instance, examples of "hardware" include, but are not limited or restricted to an integrated circuit such as a processor (e.g., a digital signal processor, microprocessor, application specific integrated circuit, a micro-controller, etc.). Further, "a processor" may encompass one or more processors, such as a processor in a remote server working with a processor on a local client machine. Of course, the hardware may be alternatively implemented as a finite state machine or even combinatorial logic. An example of "software" includes executable code in the form of an application, an applet, a routine or even a series of instructions. The software may be stored in any type of machine-readable medium.

Figure 1:
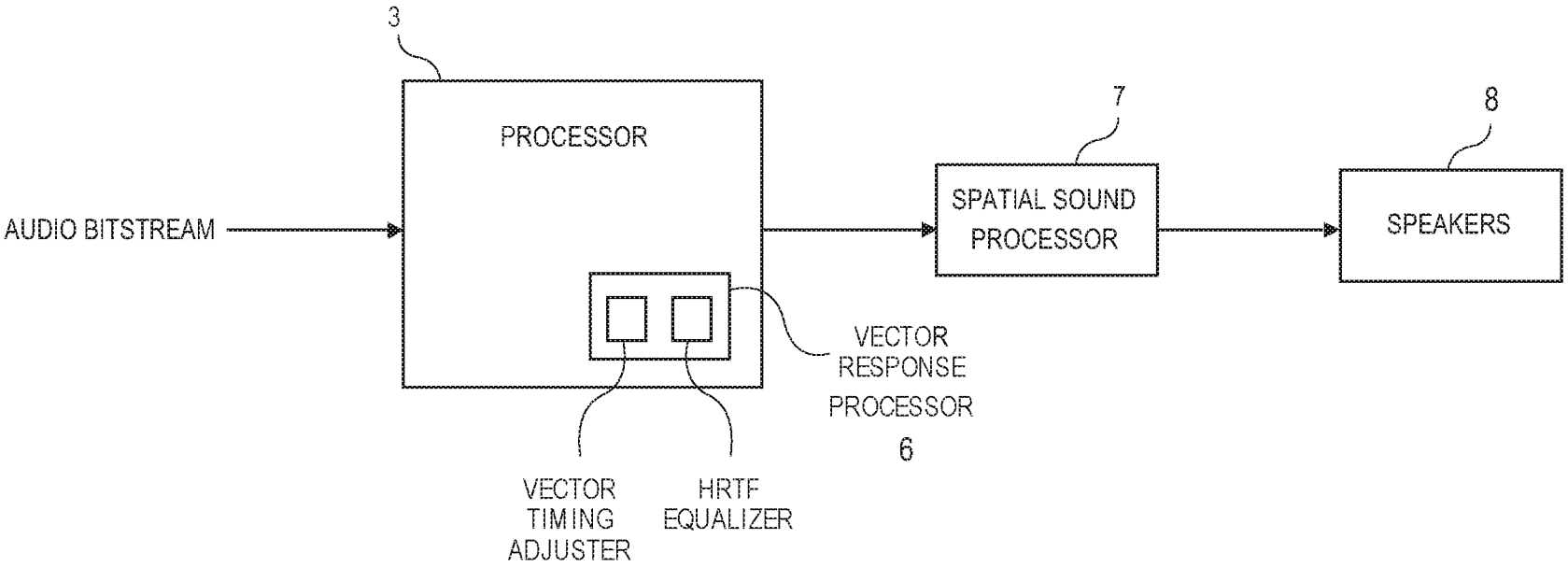
FIG. 1 illustrates a block diagram of a system for binaural reproduction of surround sound using a virtualized line array.

FIG. 1 illustrates a block diagram of a system for binaural reproduction of surround sound using a virtualized line array according to one aspect of the disclosure here. The system includes a processor 3, a spatial sound processor 7, and headphone speakers 8. The headphone speakers 8 may include, for example, one or more left ear drivers and one or more right ear drivers.

In an aspect, the processor 3 and spatial sound processor 7 may each include a processor, such as a microprocessor, a microcontroller, a digital signal processor, or a central processing unit, and other needed integrated circuits such as glue logic. In an aspect, the processor 3 and spatial sound processor 7 may be a single processor. The term "processor" may refer to a device having two or more processing units or elements, e.g. a CPU with multiple processing cores. The processor 3 and spatial sound processor 7 may execute software instructions or code stored in a storage. The storage may include one or more different types of storage such as hard disk drive storage, nonvolatile memory, and volatile memory such as dynamic random access memory. In some cases, a particular function as described below may be implemented as two or more pieces of software in the storage that are being executed by different hardware units of a processor. The processor 3 includes a vector response processor 6, which may include a vector timing adjuster or an HRTF equalizer used for timbral correction as described below.

Figure 2:
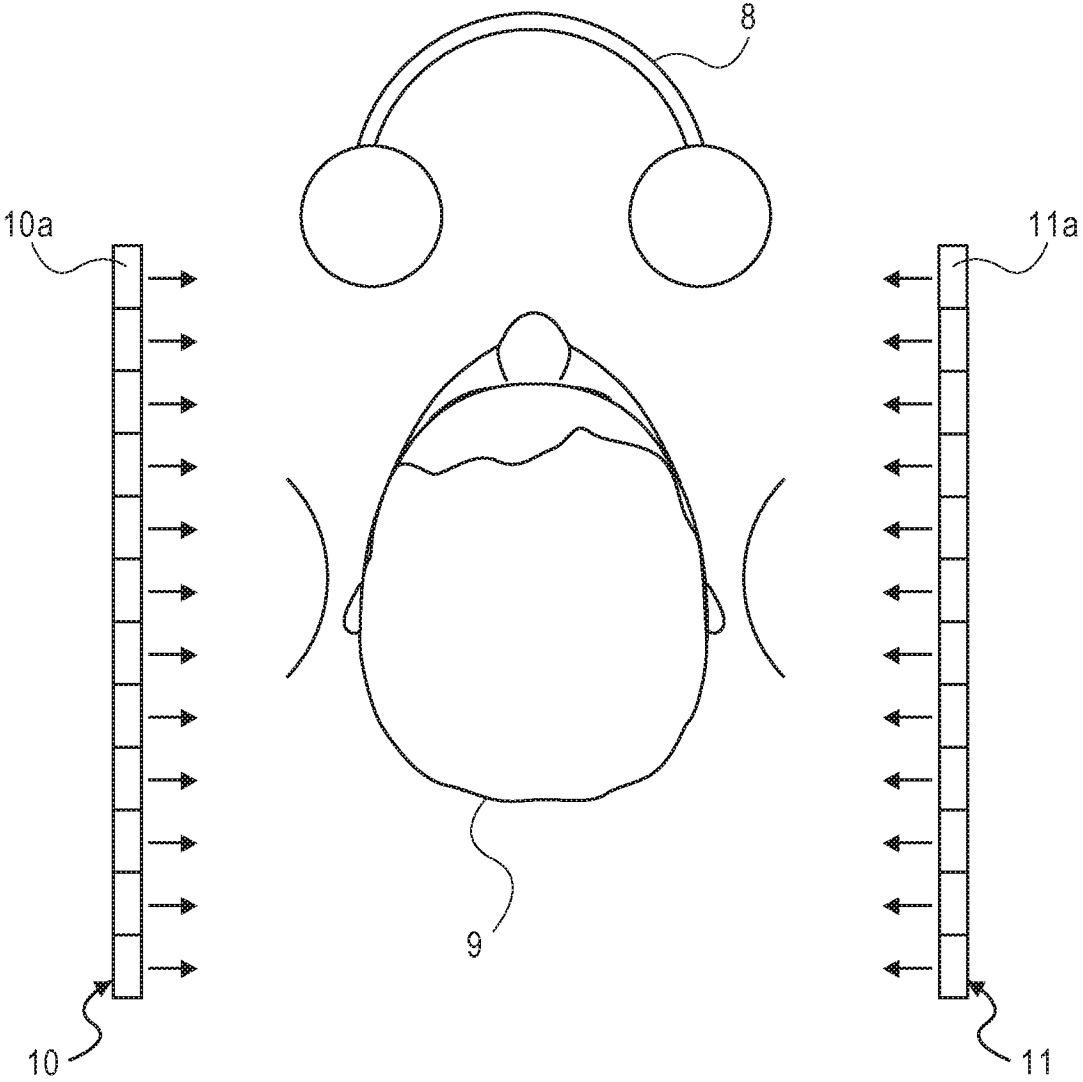
FIG. 2 illustrates an exemplary virtualized line array playback configuration.

The processor 3 receives the audio bitstream containing a surround sound channel, e.g., a 5.1 surround format having left and right surround channels, and renders the surround sound channel into a digital signal that is referred to here as the spatialized surround channel digital signal. As illustrated in FIG. 2, this digital signal contains the surround channel that has been spatialized to appear to a listener 9 as emanating from a virtualized line array source, which includes a first virtualized line array source 10 and a second virtualized line source 11. The first virtualized line array source 10 and the second virtualized line array source 11 may be interchangeable, such that all description of configuration and operation could apply to both the first virtualized line array source 10 and the second virtualized line array source 11, and any reference to a virtualized line array source could include both the first virtualized line array source 10 and the second virtualized line array source 11.

The first virtualized line array source 10 may have the characteristics of a line array source as it would sound in a simulated virtual environment. The first virtualized line array source 10 may be produced by, for example, rendering the surround channel as a plurality of finite source elements 10*a* located in virtual space that have a plurality of vector component responses, with each vector component response associated with a respective finite source element 10*a*, and each impulse vector representing the same output of the surround channel. The second virtualized line array source 11 is also produced during the same rendering, and the finite source elements 11*a* of the second virtualized line array source 11 may work in partnership with the respective finite source elements 10*a* of the first virtualized line array 10 to produce a sense of immersion in the listener 9 during playback. The plurality of finite source elements 10*a* may be placed in proximity in virtual space at substantially the same elevation along the azimuth. The plurality of finite source elements 10*a* may be of sufficient density and unity so as to seem a continuous virtualized line array source 10 to a listener 9, e.g., the listener 9 should not be able to determine that the virtualized line array source 10 is composed of finite source elements 10*a*. In an example, the finite source elements 10*a* may all be located at the same elevation along the azimuth as the listener's ears. In another aspect, the finite source elements 10*a* may be located at the same elevation along an azimuth above the listener 9, such as to form an overhead array. In another aspect, the finite source elements 10*a* may be located at the same elevation along an azimuth below the listener 9. In one aspect, the finite source elements 10*a* may be located at any of varying elevations and varying azimuths, such that the virtualized line array source 10 may be substantially vertical, horizontal, or at an angle, so long as the virtualized line array source 10 seems continuous to the listener 9. The vector component responses may all be substantially uniform, such that a plurality of virtual listeners that are equidistant from a plurality of finite source elements 10*a* will all perceive a vector component response at the same time. The processor 3 (see FIG. 1) may also adjust the gain of the vector component responses, where necessary, to produce a desired effect, such as equalized gain across the virtualized line array source.

The processor 3 may also upmix or downmix the surround channel of the audio bitstream. The audio bitstream may take the form of multichannel audio, objected based audio, scene based audio, and any other type of audio source encoded with a surround sound channel. The audio bitstream may correspond to a music composition, a track for a television show or movie, and any other type of audio work. For an audio bitstream with one surround sound channel, the processor 3 may upmix the one surround sound channel to produce the spatialized surround channel digital signal. For an audio bitstream with a plurality of surround sound channels, the processor 3 may downmix the plurality of surround sound channels to produce the digital signal.

Figure 3:
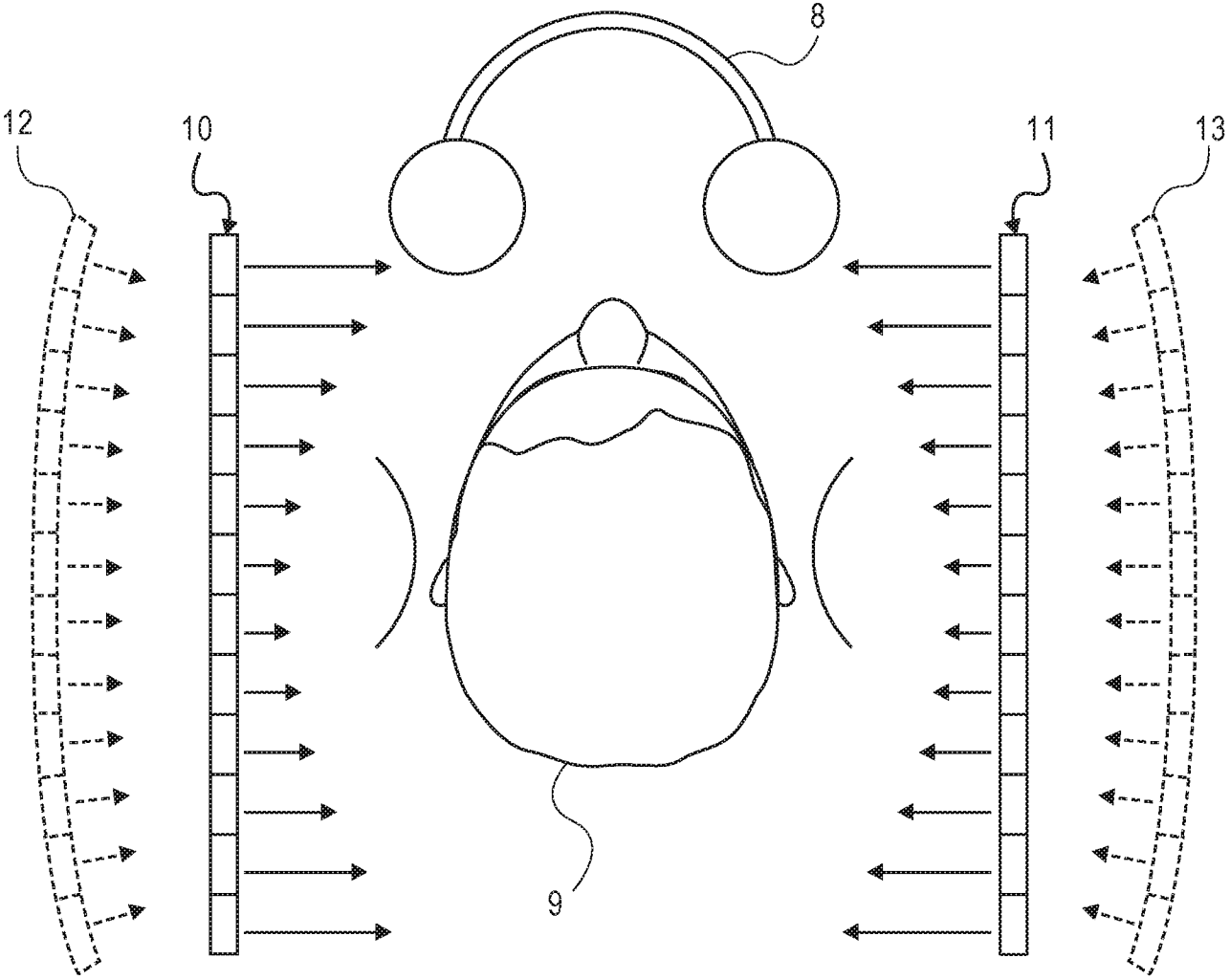
FIG. 3 illustrates an exemplary playback configuration that has a non-uniform vector component response.

The vector component response processor 6 receives the spatialized surround channel digital signal. In one aspect, the digital signal is sent to the vector timing adjuster. The vector timing adjuster delays the playback timing of each finite source element 10*a* so that the playback timing of the vector component responses is non-uniform. FIG. 3 shows an aspect of the disclosure where the timing of playback by each finite element 10*a* of the first virtualized line array source 10 is delayed so as to produce a vector response pattern where each vector component response reaches the listener 9 at substantially the same time. For example, the timing of the playback of each vector component response is variably timed depending on its distance from the center point of the virtualized sound array source 10. The center point of the virtualized sound array source 10 may be the finite source element 10*a* of a virtualized line array source 10 that is most adjacent (closest along a straight line) to the listener 9, such that a vector component response from said finite source element 10*a* would reach the listener first if the playback time of all finite source elements of the virtualized line array 10 were equal (synchronized). In one aspect, there is an inverse relationship between the distance of a finite source element 10*a* from the center point of the virtualized sound array source 10 and the timing of the playback, such that the delay of playback is increased the closer a finite source element 10*a* is to the center point of the virtualized sound array source 10. In other words, the delay applied to the element that is at the center point may be greatest while the delays applied to the elements that are at the opposing ends are the smallest.

For instance, a first finite source element that is near an end of the virtualized line array source 10 may play a piece of audio content of the surround channel at a desired time. A second finite source element that is between the center point of the virtualized sound array source 10 and the first finite source element may play a piece of audio content at a time delay from the first finite source element, whereas the playback time of the second finite source element relative to the first finite source element and the distance from a center point of the virtualized line array source 10 may be calculated through numerical methods. The relationship between delay of playback time of a finite source element 10*a* and the distance between the finite source element 10*a* and the center point of the virtualized line array source 10 may be calculated such that the difference in time between the vector component response of the finite source element 10*a* reaching the user and a vector component response emanating from near a center point of the virtualized line array source 10 reaching the user is negligible. This may have the effect of producing a vector response pattern that is substantially parabolic, e.g., a listener 9 will perceive the first virtualized line array 10 as a curved virtualized line array 12 and the second virtualized line array as a curved virtualized line array 13. In one aspect, the virtualized line array 10 is synthesized by the processor 3 as a curved virtualized line array 12, such as a segment of a circle, such that during playback the individual vector component responses from all finite source elements will reach the listener 9 at substantially the same time.

Figure 4:
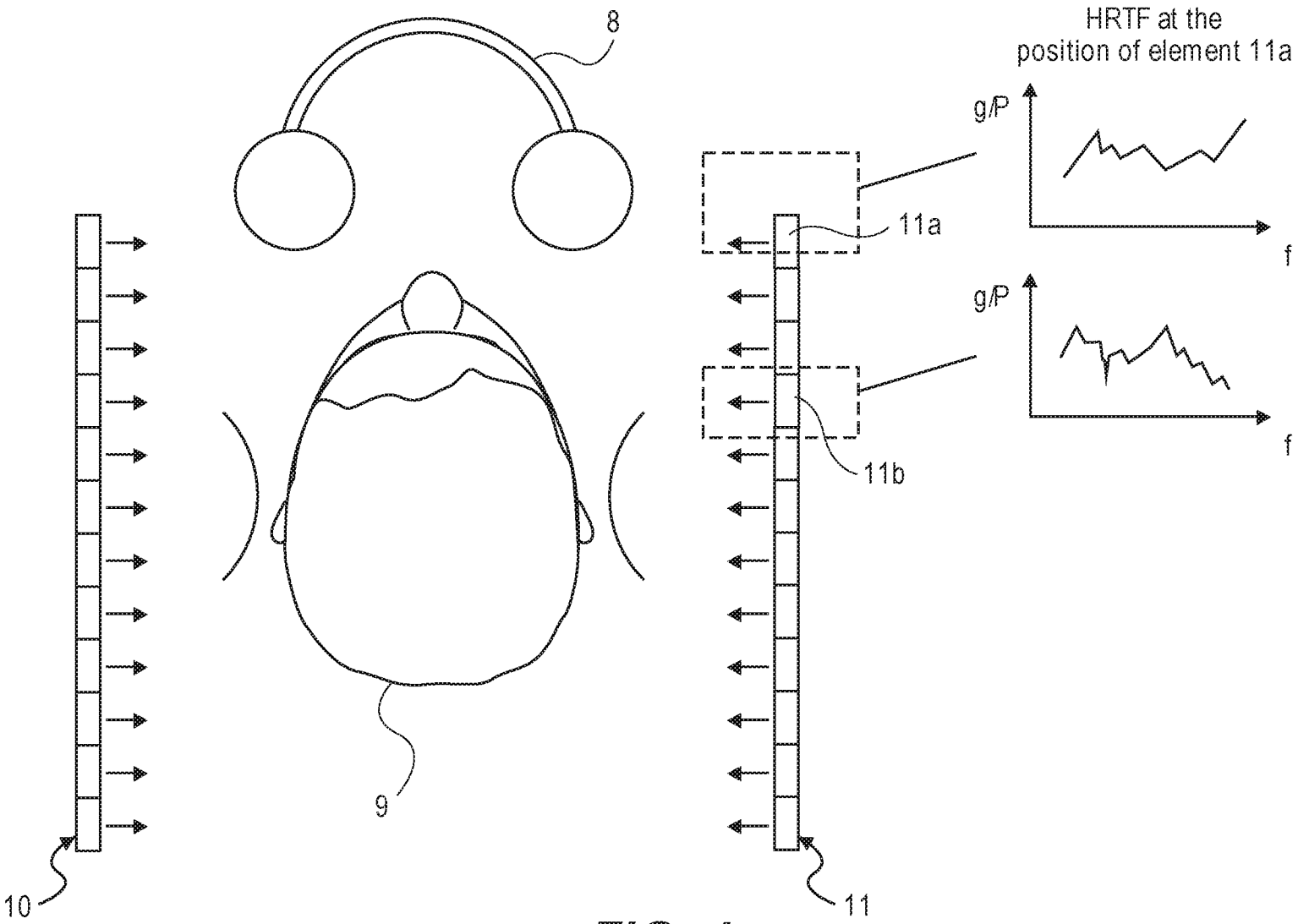
FIG. 4 illustrates an exemplary playback configuration that uses HRTF filters.

The HRTF equalizer is another tool that reduces timbral differences between finite source elements in the virtualized line array source in the spatialized surround channel digital signal. In contrast to the vector timing adjuster, the HRTF equalizer applies an HRTF filter to each finite source element 11*a* as seen in FIG. 4, such that the HRTF correction of a first vector component response from a first finite element 11*a* of the virtualized speaker array source 11 may be different from the HRTF correction of a second vector component response from a second finite element 11*b* of the virtualized speaker array source 11. The first finite element may have an HRTF filter that is optimized for the angle of arrival of the first vector component response to the listener 9. The second vector component response may be equalized to the HRTF-corrected first vector component response such that the second vector component response may appear to a listener 9 to have a similar perceived approach angle to the HRTF-corrected first vector component response. For example, the difference of squares may be calculated between the first vector component response and the second vector component response. Equalization may be applied to second finite source element 10*a* based on an inverse of the difference of squares, so as to match the timbre of the second vector component response to the timbre of the first vector component response. In an aspect, correcting the individual HRTFs matches the timbre of a second finite source element to a first finite source element that is located approximately at a center point of the virtualized sound array source 10 by adjusting the vector component response angle of the second finite source element to reduce "spectral splitting" of auditory imaging. Spectral splitting may occur because the first finite source element produces a vector component response that be perceived by a listener 9 as brighter sounding because the first finite source element addresses sound straight down the ear canal with less shadowing, while the second finite source element, which is farther from the center point, produces a vector component response that are perceived by the listener 9 as duller because the vector component response encounters the outer ear.

A result of the vector response processor 6 performing a time alignment upon a virtualized speaker array source 10 (as described above using the vector timing adjuster) may be similar in principle to smoothing the HRTF across the range of angles spanned by the elements 10*a*, 10*b*, . . . of the virtualized speaker array source 10, e.g., computing an average HRTF across those elements 10*a*, 10*b* and then applying, by the binaural processor (spatial sound processor 7) the same, average HRTF to all of the elements of the virtualized speaker array source 10, to produce the left and right headphone signals.

Figure 5:
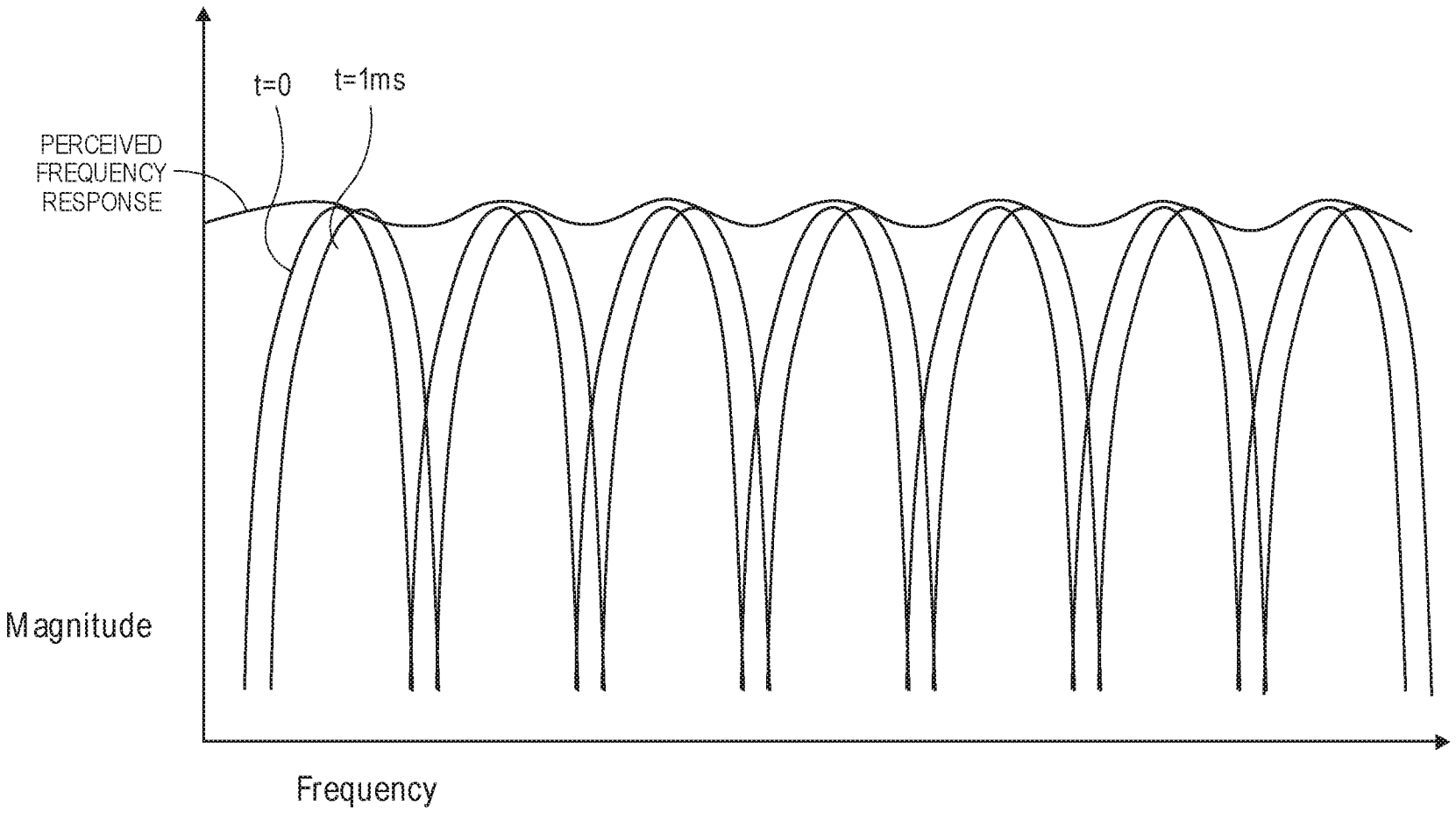
FIG. 5 illustrates an exemplary frequency response diagram when comb filtering is utilized.

Another approach for timbral correction is to configure the vector response processor 6 to apply comb filtering to the spatialized surround channel digital signal. For example, FIG. 5 shows a frequency-amplitude diagram of a second instance of the surround channel that is added during playback of the surround channel from the first virtualized speaker array source 10, wherein the second instance of the surround channel is time-delayed. In an aspect, the delay could be approximately 1-3 ms. The delay may increase the density of the comb filtering such that the comb-filtering becomes undetectable to a listener 9, and the first virtualized sound array 10 has a timbre substantially matching a desired timbre of the surround channel, which could be, for example, the timbre of the surround channel as played by a single virtual loudspeaker. Such comb filtering may be applied "between" the left virtualized speaker array source 10 and the right virtualized speaker array source 11, where a delayed version of the surround channel is added to all elements of the left virtualized speaker array source 10. Alternatively, the comb filtering may be applied between the constituent elements of the left virtualized speaker array source 10, where a delayed version of the input signal is applied to each of the elements 10*a*, 10*b*, . . . . In yet another aspect, the comb filtering is applied to a mono surround channel that is being rendered as the left virtualized speaker array source 10, by applying alternate comb "fingers" (in the frequency domain) to alternate elements of the left virtualized speaker array source 10.

In yet another aspect of the disclosure here, rather than having the elements 10*a*, 10*b*, of the virtualized speaker array source 10 be equi-spaced as depicted in FIGS. 2-4, the spacing between the elements 10*a*, 10*b*, . . . is randomized (including pseudo randomized.) That may help better diffuse the sound source, as it may be similar to simulating early reflections (surrounding a direct source) off of a diffuser, in the form of several clustered reflections that have different delays.

When rendering is complete, the processor 3 sends the spatialized surround channel digital signal to a spatial sound processor 7, such as a binaural processor, which then generates a number of speaker output signals. In the case of binaural reproduction, the spatial sound processor 7 generates left and right speaker output signals which are left and right headphone driver signals, by applying a binaural rendering algorithm to the spatialized surround channel digital signal, and transmits the speaker output signals to the speakers 8 which are in this case headphones (for playback or output as sound.) The spatial sound processor 7 generates the speaker output signals by applying head related transfer function (HRTF) filters to the digital signal to produce a left ear component and a right ear component that together drive the headphone speakers to reproduce the acoustical waveforms at a listener's eardrums as they would have been present at a listener's eardrums if the surround sound had emanated from an actual line array source.

The following aspects may be described as a process, which may be depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a procedure, etc.

Figure 6:
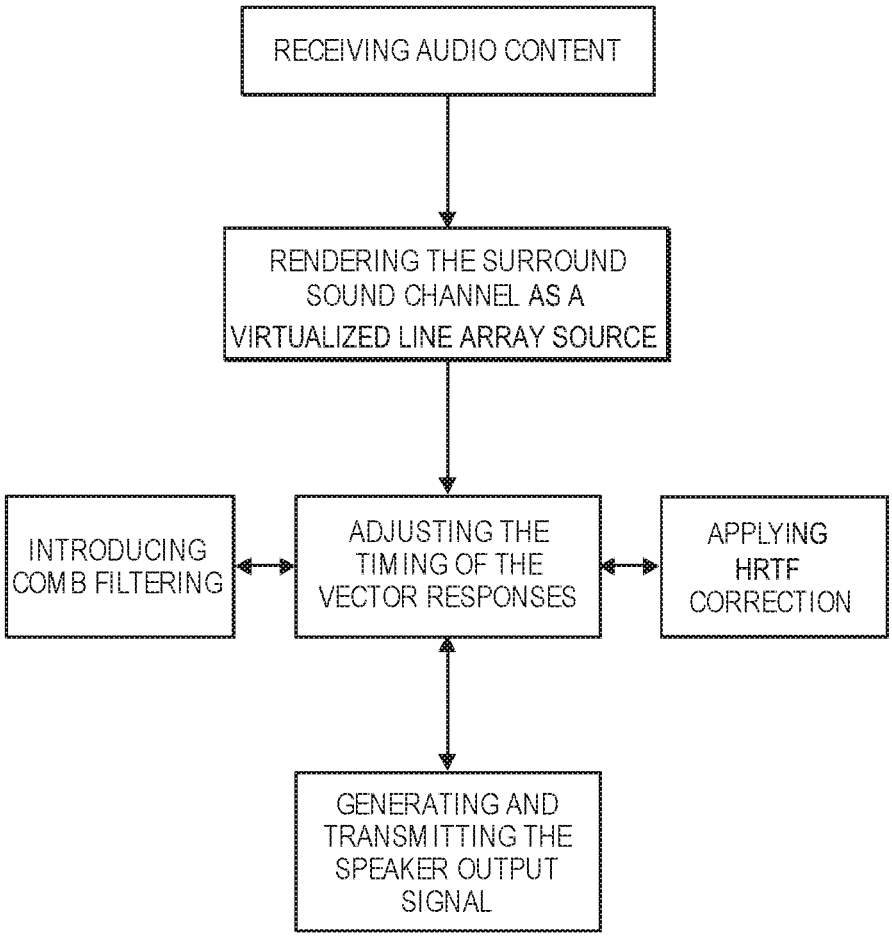
FIG. 6 illustrates a flow diagram of an example method for binaural reproduction of surround sound using a virtualized line array.

FIG. 6 illustrates a method for playback of a surround sound channel in an audio bitstream (audio content) via converting the surround sound channel into a virtualized line array source 10. The audio content is received, including the audio bitstream containing the surround sound channel, and a processor then renders the surround sound channel into a spatialized surround channel digital signal in order to generate a spatial perception of the surround sound channel as a virtualized line array source 10 made up of a plurality of finite source elements 10*a*, with the surround sound channel perceivable by the listener 9 as each of a plurality of vector component responses emanating from an associated finite source element 10*a* of the virtualized line array source 10. The processor then applies timbre correction to the virtualized line array source 10, which may include one or more of the following: adjusting the timing of playback by each finite element of the virtualized line array source so as to produce a vector response pattern where each vector component response reaches the user at substantially the same time; applying HRTF correction to each finite source element; and introducing comb filtering to the virtualized line array source 10. The processor then outputs the digital signal to a spatial sound processor 7, such as a binaural processor, which generates a plurality of speaker output signals from the timbre-corrected virtualized line array source 10, e.g., through binaural synthesis using HRTFs to create left headphone and right headphone components. The speaker output signals are transmitted to speakers 8, where they drive a plurality of speakers within an audio playback system. For example, the speaker output signal may be transmitted to headphones, and the headphone speaker drivers will produce the virtualized line array source 10.

An aspect of the disclosure is a machine-readable medium having stored thereon instructions which program a processor to perform some or all of the operations described above. A machine-readable medium may include any mechanism for storing or transmitting information in a form readable by a machine (e.g., a computer), such as Compact Disc Read-Only Memory (CD-ROMs), Read-Only Memory (ROMs), Random Access Memory (RAM), and Erasable Programmable Read-Only Memory (EPROM). In other aspects, some of these operations might be performed by specific hardware components that contain hardwired logic. Those operations might alternatively be performed by any combination of programmable computer components and fixed hardware circuit components.

While the disclosure here has been described in terms of several aspects, those of ordinary skill in the art will recognize that the disclosure is not limited to the aspects described, but can be practiced with modification and alteration within the spirit and scope of the appended claims. The description is thus to be regarded as illustrative instead of limiting. There are numerous other variations to different aspects described above, which in the interest of conciseness have not been provided in detail. Accordingly, other aspects are within the scope of the claims.

What is claimed is:

1. A method for producing a diffuse surround sound field, comprising:

receiving by a processor an audio bitstream containing a surround channel;

rendering the surround channel as at least one virtualized line array source that comprise a plurality of finite source elements;

applying timbre correction to the virtualized line array source wherein applying timbre correction comprises producing timing of playback by each finite source element of the virtualized line array source as being non-uniform and being delayed more for elements closer to a center of the virtualized line array source than for elements closer to an end of the virtualized line array source; and generating a speaker output signal from the timbre-corrected virtualized line array source for driving at least one of a plurality of speakers.

2. The method of claim 1, wherein the surround channel contains a first surround channel and a second surround channel.

3. The method of claim 1, wherein a virtualized line array source has characteristics of a line array speaker in a simulated virtual environment.

4. The method of claim 1, wherein the virtualized line array source is at a single elevation along the azimuth.

5. The method of claim 1, wherein generating a speaker output signal for driving at least one of the plurality of speakers comprises processing the timbre-corrected virtualized line array source through a binaural processor for headphone playback.

6. The method of claim 5, wherein the virtualized line array source is curved.

7. A method for producing a diffuse field, comprising:

receiving by a processor an audio bitstream containing an at least one surround channel;

rendering the surround channel as at least one virtualized line array source that comprises a plurality of finite source elements; and applying a timbre correcting method to the virtualized line array source wherein the timbre correcting method comprises producing timing of playback by each finite source element of the virtualized line array source as being non-uniform and being delayed more for elements closer to a center of the virtualized line array source than for elements closer to an end of the virtualized line array source.

8. The method of claim 7, wherein the virtualized line array source has characteristics of a line array speaker in a virtual room.

9. The method of claim 7, wherein the virtualized line array source is at a single elevation along the azimuth.

10. The method of claim 7, wherein the surround channel contains a first surround channel and a second surround channel.

11. The method of claim 7 further comprising generating a plurality of speaker output signals from the timbre-corrected virtualized line array source for driving a plurality of speakers.

12. The method of claim 11 wherein generating a plurality of speaker output signals comprises processing the timbre-corrected virtualized line array source through a binaural processor for headphone playback.

13. The method of claim 7 wherein the virtualized line array source is curved.

14. An apparatus for producing a diffuse surround sound field, comprising:

a processor; and memory having stored therein instructions that when executed by the processor cause the processor to:

receive an audio bitstream containing a surround channel;

render the surround channel as at least one virtualized line array source wherein the virtualized line array source comprises a plurality of elements whose spacing is random or pseudo random;

apply timbre correction to the virtualized line array source; and generate a speaker output signal from the timbre-corrected virtualized line array source for driving at least one of a plurality of speakers.

15. The apparatus of claim 14, wherein the surround channel contains a first surround channel and a second surround channel.

16. The apparatus of claim 14, wherein a virtualized line array source has characteristics of a line array speaker in a simulated virtual environment.

17. The apparatus of claim 14, wherein the virtualized line array source is comprised of a plurality of finite source elements.

* * * * *